United States Patent [19]

Melamed

[11] 4,254,818

[45] Mar. 10, 1981

[54] METHOD AND MEANS FOR THE COOLING OF HEAT GENERATING INDUSTRIAL OPERATIONS

[76] Inventor: Avraham Melamed, 31 Oranim St., Kfar Shemaryahu, Israel

[21] Appl. No.: 56,656

[22] Filed: Jul. 11, 1979

[30] Foreign Application Priority Data

Aug. 21, 1978 [IL] Israel ..... 55402

[51] Int. Cl.[3] ..... F28F 19/00; F28F 23/00

[52] U.S. Cl. ..... 165/1; 60/690; 165/45; 165/104 M; 165/134 R; 252/67; 252/71

[58] Field of Search ..... 165/134 R, 104 M, 134 DP, 165/45, 1; 252/67, 71; 60/690, 692

[56] References Cited

U.S. PATENT DOCUMENTS

| | | | |
|---|---|---|---|
| 2,180,624 | 11/1939 | Binns | 252/71 |
| 2,792,343 | 5/1957 | Vogler | 165/134 R |
| 3,203,873 | 8/1965 | Wirth, Jr. | 165/134 R |

*Primary Examiner*—Sheldon J. Richter
*Attorney, Agent, or Firm*—Ladas & Parry

[57] ABSTRACT

A heat generating industrial operation is cooled by means of an aqueous brine of a concentration of 20–35% by weight. The brine is flown in closed cycle between a heat exchanger of said operation and a cooling pond in which the desired brine concentration is maintained.

8 Claims, 2 Drawing Figures

METHOD AND MEANS FOR THE COOLING OF HEAT GENERATING INDUSTRIAL OPERATIONS

The present invention concerns a method and means for the cooling of heat generating industrial plants, fuel operated electric power stations and quite generally any heat generating industrial operation that requires water cooling. In the following the invention will be described with particular reference to fuel operated electric power stations (hereinafter for short "power stations"), it being understood that the invention is not confined thereto.

Power stations are commonly cooled by means of water or solutions from a natural reservoir, such as a lake or the sea, using an open, one-through cooling cycle. Ordinary water and in par ticular brackish and sea water with a salinity of up to about 4% by weight are corrosive and consequently all the components in known cooling systems for operations of the kind specified, e.g. pipes, heat exchangers, pumps, etc., have to be of a corrosion resistant metal or alloy. Corrosion resistant metals and alloys are expensive and consequently the requirement for such metals and alloys for the construction of cooling systems for operations of the kind specified impose a considerable burden on the capital investment.

In a direct and open cycle water cooling system, the direct return of spent warm water discharged from the heat generating operation in large quantities into the natural reservoir from which it is derived may cause thermal pollution of the reservoir. It is known that where desirable such adverse environmental effects may be prevented by discharging the warm cooling water into a natural or artificial pond, lake or the like water body (hereinafter "cooling pond") in which the spent warm water is cooled prior to its being discharged into the sea and in this way the undesired thermal pollution is avoided.

The present invention is based on the observation that as distinct from ordinary water, brackish water and sea water, highly concentrated saline brines are characterized by a low corrosivity towards metals.

Accordingly the invention provides a method of cooling a heat generating industrial operation comprising establishing in said operation a cooling system of a metal or alloy corrodible by water and dilute aqueous saline solutions, further establishing a cooling pond holding a body of an aqueous saline solution of a concentration of about 20 to 35% by weight and flowing brine in closed circuit between said pond and cooling system.

A cooling pond used in accordance with the invention may comprise means for the withdrawal of spent brine and the feed of make-up solution, such withdrawal and feed being so controlld that a desired, steady state concentration of the brine in the pond is maintained.

It is thus seen that the method according to the invention differs from the prior art in that a highly concentrated brine is used as coolant, as distinct from ordinary water, brackish water or sea water used in accordance with the prior art. Hitherto it has always been the aim to reduce the salinity of cooling water as far as possible in order to reduce in this way the corrosion and damages ensuing therefrom. The invention is thus diametrically opposed to this state of the art.

In accordance with the present invention it is possible to use for the cooling system metals and alloys, e.g. ordinary iron, which corrode in contact with water and dilute saline solution such as brackish or sea water, since such metals and alloys do not significantly corrode in contact with a concentrated saline brine. Consequently the invention provides for a significant reduction of the capital investment in the cooling system of an industrial operation.

In a cooling pond there exists a dynamic equilibrium between evaporation, withdrawal of spent brine, make-up and uptake of natural precipitates. Of these, the withdrawal of spent brine and the make-up are controllable and they will be so controlled that with the pond a steady state concentration and temperature are maintained.

If desired, the spent brine withdrawn from the cooling pond may be subjected to a treatment for the recovery of salts therefrom by any method known per se.

Where a natural brine having the desired concentration is available from a natural source, e.g. in the Dead Sea area, Israel, such brine can be used directly for the purposes of the present invention. In other cases where such brines are not naturally available they are prepared in situ by making a pond of the desired size, filling it with brackish or sea water and subjecting it to evaporation and continuous or intermittent make-up until a brine of the desired concentration is obtained. This procedure may require a considerable time and therefore it is preferably started together with the erection of the industrial operation concerned so that at the time when the erection is completed the brine in the pond will have reached the desired concentration.

The surface area and size of the pond will depend on the cooling requirements. Where the operation is, for example, a fuel operated electric power plant the surface area of the pond may be of the order of 5 to 20 $m^2$ per KW of design power output, the precise area depending on local climatic conditions.

The temperature in the pond is lower than in the cooling system of the plant. Consequently insofar as the solubility of the constituent salts increases with temperature any precipitation will occur in the pond and there will be no precipitation in the cooling system. There are, however, some salts such as, for example, calcium sulphate and calcium carbonate, whose solubility decreases with temperature; or else precipitation in the cooling pond may be incomplete. In order to avoid any danger of salt precipitation in the cooling system which, if it were to happen would impair heat transfer across the walls, it is possible in accordance with one embodiment of the invention, to provide an auxiliary vessel or pond in which part of the brine returning from the plant is contacted with make-up solution to precipitate therefrom salts whose solubility drops with temperature, and a supernatant solution from such precipitation is then fed to the main pond.

The invention further provides a heat producing industrial plant comprising a cooling system of a metal or alloy corrodible by water and a dilute saline solution, and associated therewith a pond holding an aqueous brine of a sufficiently high concentration that it does not significantly corrode said metal or alloy, means being provided for flowing said brine in closed cycle between said pond and cooling system.

The invention is illustrated, by way of example only, in the accompanying drawings in which.

Figure 1:
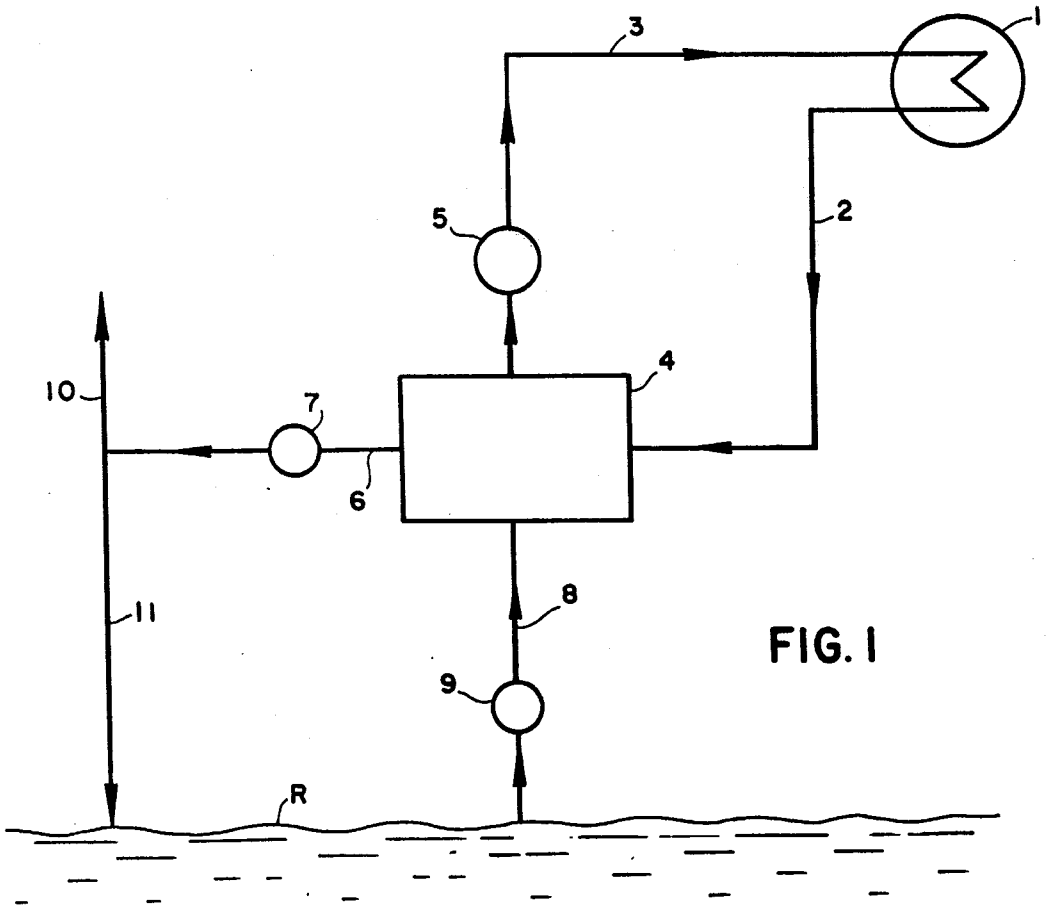
FIG. 1 is a flow diagram of a cooling system according to the invention.

In FIG. 1 the cooling system is shown to comprise a heat exchanger 1 linked through pipings 2 and 3 to a cooling pond 4 holding a saline brine. Heat exchanger 1 forms part of an industrial operation that is not shown. Brine from pond 4 flows in a closed cycle between the pond and heat exchanger 1 by means of a pump 5. Excess spent brine is withdrawn from pond 4 through piping 6 by a bleed out pump 7 and make-up saline solution from a natural reservoir R, e.g. sea water, is fed into pond 4 through piping 8 by means of a pump 9.

The spent brine withdrawn through piping 6 can be diverted at will to either of pipings 10 and 11 or divided between them, means (not shown) being provided for directing or dividing the flow of the spent brine as desired. Brine directed to piping 10 is conducted to a salt recovery operation while brine directed to piping 11 is flown directly to the natural reservoir R. The mother liquor from the salt recovery operation may also be discharged into reservoir R or alternatively recycled as make-up to pond 4.

Figure 2:
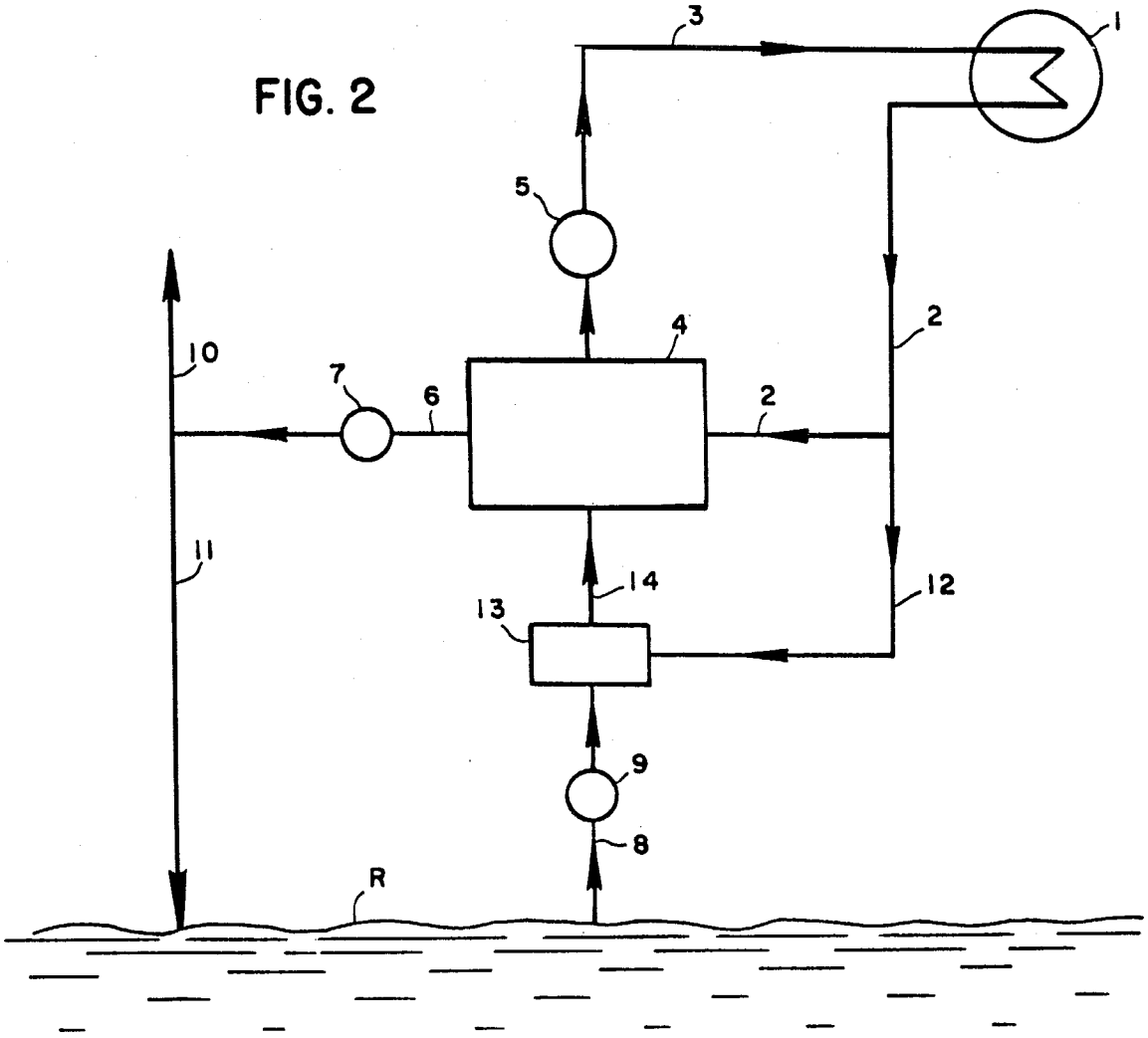
FIG. 2 is a flow diagram of another embodiment.

The arrangement according to FIG. 2 is similar as that of FIG. 1 and similar constituents are marked with the same numerals. It comprises in addition a piping 12, an auxiliary pond 13 and piping 14. During operation some of the recycled cooling brine arriving from heat exchanger 1 is tapped off from duct 5 by means of dividing means (not shown) and conducted through piping 12 into pond 13 where it comes into contact with make-up solution arriving through piping 8. By this contact any salts contained in the make-up solution whose solubility product is low, e.g. $CaSO_4$ and $CaSO_3$, precipitate in pond 13. From the pond 13 the clear supernatant solution flows through piping 14 into the cooling pond 4 and the remaining operation is as in FIG. 1.

The following numerical example will further illustrate the invention:

A 1,000 MW fuel operated power station is associated with a cooling pond having a surface area of 5 $km^2$. The annual rate of evaporation is 1,800 mm and the annual amount of natural precipitations is 400 mm. The seepage into the ground is assumed to be zero and the annual withdrawal of spent brine is 1,000,000 $m^3$.

The annual make-up consists of $8\times10^6$ $m^3$ of sea water whose concentration is 4.0% by weight and whose mean annual temperature is 20° C.

The temperature of the brine arriving from the power station is about 30° C. and its annual throughput through the pond is of the order of $10^9$ $m^3$.

Under the above conditions a steady state is maintained in the pond in which the concentration of the brine is 32% by weight and the temperature is 22° C.

What is claimed is:

1. A method of cooling a heat generating industrial operation comprising establishing in said operation a cooling system of a metal or alloy corrodible by water and dilute aqueous saline solutions, further establishing a cooling pond holding a body of an aqueous saline solution of a concentration of 20 to 35% by weight and flowing brine in closed circuit between said pond and cooling system.

2. A method according to claim 1 wherein said pond is open and the brine withdrawal and make-up are so controlled with respect to evaporation and water addition due to natural precipitates that a desired steady state concentration of the brine in the pond is maintained.

3. A method according to claim 2 serving for the cooling of a fuel operated electric power station.

4. A method according to claim 1 comprising installing an auxiliary vessel or pond in the path of the make-up solution to the cooling pond, diverting to such auxiliary vessel or pond part of the hot brine discharged from said cooling system to bring about in the pond the precipitation of salts contained in the make-up solution liable to precipitate in the cooling system, and flowing a clear supernatant solution from said auxiliary vessel or pond to the cooling pond.

5. A method according to claim 4 wherein the salts that precipitate in said auxiliary vessel or pond are calcium carbonate and calcium sulphate.

6. A method according to claim 1 wherein spent brine withdrawn from the cooling pond is subjected to a salt recovery operation.

7. A heat producing industrial plant comprising a cooling system of a metal or alloy corrodible by water and a dilute saline solution, and associated therewith a pond holding an aqueous brine of a concentration of 20–35% by weight, means being provided for flowing said brine in closed cycle between said pond and cooling system.

8. A plant according to claim 7 being a fuel operated electric power station.

* * * * *